US007055496B1

(12) United States Patent
Majewski et al.

(10) Patent No.: US 7,055,496 B1
(45) Date of Patent: Jun. 6, 2006

(54) STRATEGY FOR ENGINE FUELING DURING RETURN TO POSITIVE POWER FLOW AFTER ENGINE BRAKE DE-ACTIVATION

(75) Inventors: Michael A. Majewski, Joliet, IL (US); James T. Beaucaire, Wheaton, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/220,464

(22) Filed: Sep. 7, 2005

(51) Int. Cl.
*F02D 1/00* (2006.01)

(52) U.S. Cl. ..... 123/319; 123/445; 123/480

(58) Field of Classification Search ..... 123/319, 123/320, 321, 322, 445, 478, 480, 531, 532, 123/533
See application file for complete search history.

(56) References Cited

U.S. PATENT DOCUMENTS 6,807,938 B1 10/2004 Majewski et al.
6,938,598 B1 * 9/2005 Lewis et al. ..... 123/179.1
2005/0172934 A1 * 8/2005 Allen et al. ..... 123/399
2005/0205046 A1 * 9/2005 Lewis et al. ..... 123/198 F
2005/0205047 A1 * 9/2005 Lewis et al. ..... 123/198 F
2005/0205048 A1 * 9/2005 Winstead ..... 123/198 F
2005/0205054 A1 * 9/2005 Lewis et al. ..... 123/315
2005/0205059 A1 * 9/2005 Lewis et al. ..... 123/432

* cited by examiner

*Primary Examiner*—John T. Kwon
(74) *Attorney, Agent, or Firm*—Dennis Kelly Sullivan; Susan L. Lukasik; Jeffrey P. Calfa

(57) ABSTRACT

An internal combustion engine that propels a vehicle has a fuel injection system for injecting fuel into engine cylinders at desired injection control pressure. A control system controls activation and de-activation of a hydraulic actuator for an engine brake. A processor processes data to develop data for desired injection control pressure. Transitional injection control pressure data is used as desired injection control pressure during a transition time interval that commences with de-activation of the engine brake caused by the relief of pressure of the control fluid for allowing resumption of positive power flow from the engine for propelling the vehicle and that ends after the processor has determined the existence of a predetermined correlation between the transitional injection control pressure data and data indicating pressure of the control fluid.

21 Claims, 1 Drawing Sheet

STRATEGY FOR ENGINE FUELING DURING RETURN TO POSITIVE POWER FLOW AFTER ENGINE BRAKE DE-ACTIVATION

FIELD OF THE INVENTION

This invention relates generally to internal combustion engines for propelling motor vehicles, and particularly to a transitional fueling strategy for fueling an engine as an engine brake that had previously been activated to slow the engine is being deactivated so that the engine can return to delivering positive power for propelling a vehicle.

BACKGROUND OF THE INVENTION

Various devices can be associated with an internal combustion engine that powers a motor vehicle to brake the engine by itself. Such engine brakes can be useful in larger vehicles like highway trucks. A known technique for retarding an internal combustion comprises augmenting engine back-pressure. One way of doing this comprises restricting the exhaust gas flow from the engine. In a conventional camshaft engine, a valve that is disposed in the exhaust system, sometimes called an exhaust brake, can be operated to restrict the exhaust gas flow. In an engine that has variable valve actuation, the individual cylinder exhaust valves may be actuated in a manner that creates the desired restriction.

It is known the use hydraulic control fluid for operating an engine brake. When the brake is to be applied (activated), fluid under pressure is delivered to an actuator for the brake to operate the brake. When the brake is to be released (de-activated), the fluid is dumped from the actuator to relieve the applied pressure and allow the brake to release.

Certain diesel engines have fuel injection systems that utilize hydraulic fluid under pressure to force fuel into engine combustion chambers. The hydraulic fluid is supplied to a respective fuel injector at each engine cylinder. When a valve mechanism of a fuel injector is operated by an electric signal from an engine control system to inject fuel into the respective cylinder, the hydraulic fluid is allowed to act on a piston in the fuel injector to force a charge of fuel into the respective combustion chamber.

A running engine experiences a transition in operation when an engine brake is released and the engine returns to delivering positive power for propelling a vehicle. If fueling is not suitably controlled during the transition, the transition may not be as smooth as desired. A rough transition is evidenced by engine misfire and the consequent generation of excess smoke in the engine exhaust.

It has been observed that a contributing factor to engine roughness during such transitions is the rate at which the engine brake releases. If the hydraulic fluid that is activating the brake is not dumped sufficiently fast from the actuator, cylinder misfires and extra exhaust smoke may result. For example, delayed release of a brake acting on engine exhaust valves can cause them to stay open longer than desirable, potentially causing misfires and extra smoke in the exhaust. Hence it is generally desirable to dump the hydraulic fluid as rapidly as possible so that engine braking can promptly end in anticipation of a return to positive power delivery. But during dumping, fueling must be controlled in a way that can accommodate the more rapid brake de-activation.

Commonly owned U.S. Pat. No. 6,807,938 of the inventors discloses a strategy for limiting fueling after de-activation of an engine retarder that had previously been activated to brake an engine. While limiting and/or delaying fueling during the transition can provide some improvement, it is believed that further improvement would be desirable during such transitions.

SUMMARY OF THE INVENTION

The present invention relates to a new and improved fueling strategy for fueling an engine during such a transition. The transitional strategy can provide smoother transitions from the beginning of engine brake de-activation until the resumption of positive power flow from the engine through the vehicle powertrain to the vehicle drivetrain. Consequently, the potential for misfire, and resulting generation of smoke in the exhaust, is significantly reduced.

The invention can be embodied in an engine control system by a devoted transitional algorithm that temporarily interrupts a main fuel control algorithm during such a transition.

The invention allows the use of a dump valve that can more rapidly dump the hydraulic control fluid from the engine brake actuator, while in doing so, providing control of engine fueling that is appropriate for such faster dumping of the control fluid.

One general aspect of the present invention relates to an internal combustion engine that propels a vehicle and comprises a fuel injection system for injecting fuel into engine cylinders at a desired injection control pressure, a fluid-operated device that uses pressure of a control fluid for activating an engine brake to increase engine back pressure, and a control system that controls the pressure of the control fluid and comprises a processor that processes data to develop data for desired injection control pressure.

During activation of the brake, the processor develops desired injection control pressure data from a main ICP-determining strategy, and upon the control system requesting de-activation of the brake, develops desired injection control pressure data from a transitional ICP-determining strategy instead of the main ICP-determining strategy during a transition time interval that commences in response to the de-activation request.

The transition time interval continues while pressure of the control fluid acting on the device is being relieved to allow resumption of positive power flow from the engine to propel the vehicle.

The transition time interval ends after the processor has determined the existence of a predetermined correlation between transitional injection control pressure data from the transitional ICP-determining strategy that is being used as desired injection control pressure data and data indicating pressure of the control fluid acting on the device.

Another general aspect relates to a method for controlling injection control pressure at which fuel is injected into cylinders of an internal combustion engine that propels a vehicle during a transition time interval that commences with de-activation of an engine brake by the relief of pressure of a control fluid that had been acting on a device which had been braking the engine. The method comprises developing transitional injection control pressure data for use as desired injection control pressure and using the transitional injection control pressure data, to the exclusion of injection control pressure data from other sources, as the desired injection control pressure data that controls injection control pressure during the transition time interval. The transition time interval ends after the existence of a predetermined correlation between the transitional injection control pressure data and data indicating the pressure of control fluid acting on the device has been determined.

Still another general aspect relates to a control system for controlling pressure at which a fuel injection system injects fuel into engine cylinders of an internal combustion engine that propels a vehicle during a transition time interval commencing with de-activation of an engine brake by the relief of pressure of a control fluid that had previously been acting on the device to cause increased engine back pressure.

The control system comprises a processor for establishing desired injection control pressure and for causing the relief of pressure of the control fluid acting on the device to deactivate the brake. The processor processes various data to develop transitional injection control pressure data for use as desired injection control pressure data to the exclusion of injection control pressure data from other sources during the transition time interval and to develop data that determines the end of the transition time interval. The processor also processes certain data that includes at least indicated pressure of control fluid acting on the device and engine speed data in accordance with maps to select from the maps data values that are further processed to project a length of time for the transition time interval and to signal the end of the transition time interval upon pressure of control fluid acting on the device and transitional injection control pressure having maintained a predetermined correlation for the projected length of time.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
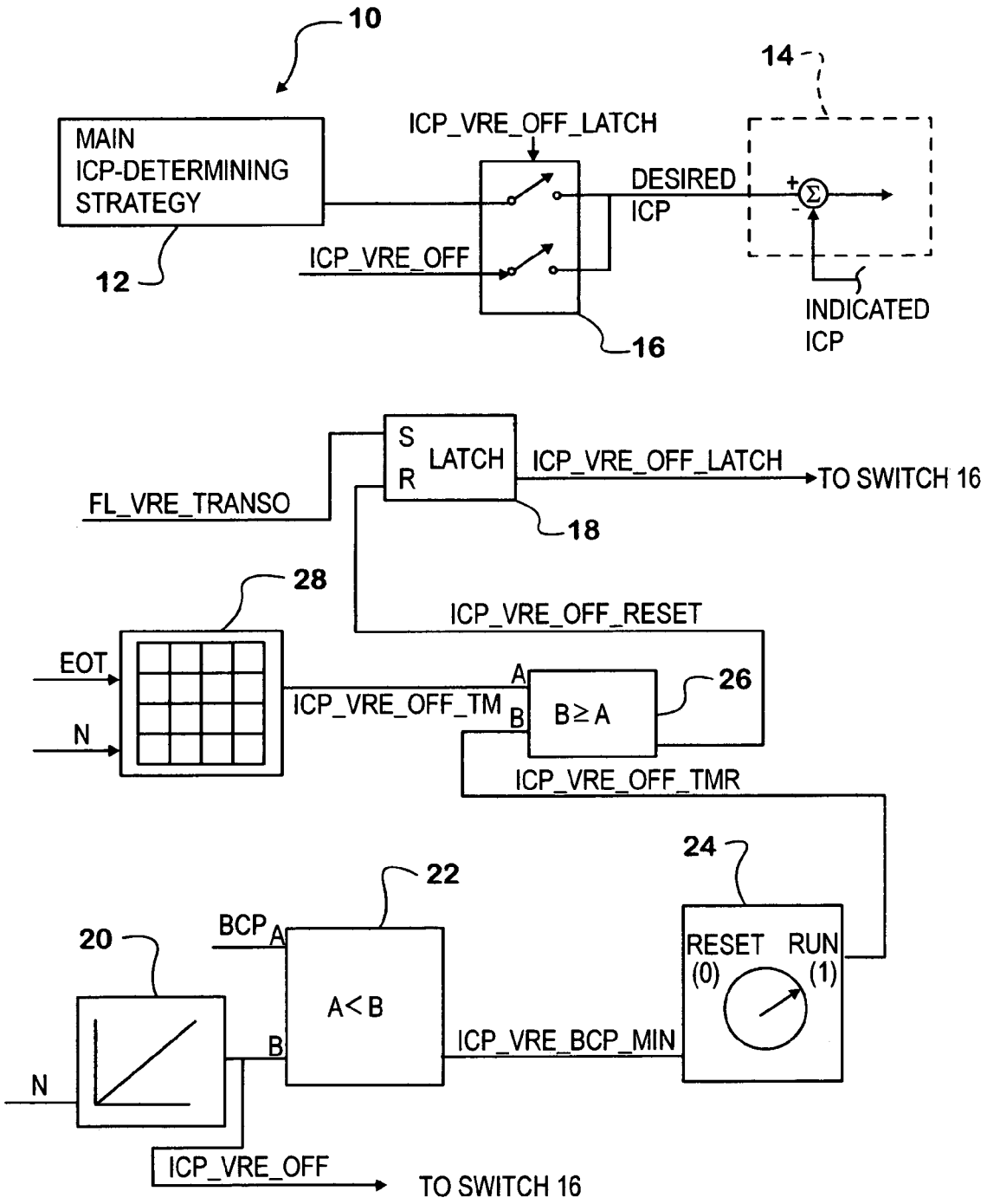
FIG. 1 is a general schematic diagram of an exemplary embodiment of software strategy for fueling an internal combustion engine and that includes a transitional fueling strategy in accordance with principles of the present invention.

FIG. 1 shows a portion of a fuel control strategy embodied in an exemplary internal combustion engine control system 10. The particular engine is a diesel engine that has a fuel injection system controlled by the fuel control strategy and an engine brake that is activated by pressure of a hydraulic control fluid. Activation and de-activation of the engine brake are controlled by requests from a portion of control system 10 not specifically shown in FIG. 1. When the brake is being applied (activated), the control system causes hydraulic control fluid under pressure to be delivered to a hydraulic actuator. When the brake is to be released (de-activated), the control system causes the hydraulic control fluid to be dumped from the actuator, relieving the pressure in the actuator and allowing the brake to de-activate.

The engine comprises cylinders forming combustion chambers in which fuel injected by fuel injectors ignites in hot air that has entered through an intake system and been compressed by pistons that reciprocate within the cylinders. The combusting mixture powers the engine, and hence propels the vehicle. Gas resulting from combustion is exhausted through an exhaust system. The fuel injectors are under the control of the fuel control strategy of system 10.

Control system 10 comprises one or more processors that process various data to develop data for controlling various aspects of engine operation including controlling pressure of hydraulic fluid for operating the fuel injectors and the timing of operation of valve mechanisms in the fuel injectors. The engine comprises a hydraulic system that supplies hydraulic fluid, with control system 10 controlling the hydraulic fluid pressure for operating the fuel injectors, which is also sometimes called injection control pressure or ICP.

When a valve mechanism of a fuel injector is operated by an electric signal from system 10 to inject fuel into the respective cylinder, the hydraulic fluid at a desired ICP is enabled to act on a piston in the fuel injector to force a charge of fuel into the respective combustion chamber. Fuel injectors of this general type are disclosed in various prior patents.

The fuel control strategy is part of the overall engine control strategy and is implemented by algorithms that are repeatedly executed by the processor, or processors. Certain algorithms form a main ICP-determining strategy 12 that develops data values for ICP that control ICP under most engine operating conditions. Those data values are processed as a command input to a virtual feedback controller 14 in control system 10 in closed-loop control of injection control pressure.

Data values for ICP processed as command inputs by controller 14 may be considered as desired ICP. A data value for indicated ICP, as measured or estimated in any suitably appropriate way, is a feedback input to controller 14. The feedback input is subtracted from the command input to create a data value for an error signal that is used by the controller to secure correspondence of ICP to desired ICP.

FIG. 1 shows that a switch 16 controls the delivery of the data values for ICP from strategy 12 to controller 14. In a first state, switch 16 passes the data values from strategy 12 so that they are used as desired ICP. In a second state, switch 16 passes the data value for a parameter ICP_VRE_OFF that is developed as a data value for desired ICP by a transitional ICP-determining strategy that develops data values for transitional ICP that is used as desired ICP to control ICP during a transition time interval that commences upon a request to de-activate the engine brake.

The state to which switch 16 operates is controlled by a parameter ICP_VRE_OFF_LATCH from a latch 18. When the data value for ICP_VRE_OFF_LATCH changes from a logic "0" to a logic "1", switch 16 changes from the first state to the second state. When the data value for ICP_VRE_OFF_LATCH changes back from a logic "1" to a logic "0", switch 16 changes from the second state back to the first state.

Latch 18 is set by a parameter FL_VRE_TRANSO and reset by a parameter ICP_VRE_OFF_RESET. Setting of latch 18 places switch 16 in the second state. Resetting of latch 18 places switch 16 in the first state. When the engine brake is being activated, desired injection control pressure data from strategy 12 is being passed by switch 16 to the command input of controller 14.

The data value for ICP_VRE_OFF represents a transitional injection control pressure that is used as the command input to feedback controller 14 during a transition time interval that commences upon a request for de-activation of the engine brake. De-activation of the brake is signaled by a change in FL_VRE_TRANSO that causes latch 18 to be set, placing switch 16 in the second state and causing the data value for ICP_VRE_OFF to become the command input to controller 14 to the exclusion of the data value from strategy 12.

The data value for ICP_VRE_OFF is obtained from a map 20 that contains data values for ICP_VRE_OFF each correlated with a data value representing a respective range of engine speeds within the overall engine speed range. A data value for indicated engine speed N is obtained from any appropriate source, such as a data link on which engine speed is regularly published, and forms an input to map 20. Processing of indicated engine speed N yields a corresponding data value for ICP_VRE_OFF from map 20.

Data for populating map 20 are obtained during engine development to provide proper fueling during the transition from brake de-activation to restoration of positive power flow from the engine through the vehicle powertrain to the vehicle drivetrain. Proper fueling during the transition promotes a smoother transition with reduced potential for both misfires and increases in exhaust smoke.

The data value for ICP_VRE_OFF is also used as an input to a logic function 22 that compares the data value for ICP_VRE_OFF with a data value for a parameter BCP that indicates pressure of hydraulic control fluid being applied to the actuator for the engine brake. This hydraulic control fluid, like the hydraulic fluid for ICP, may come from the engine hydraulic system, but at its own pressure and not necessarily at the same pressure being applied to the fuel injectors. The data value for BCP is obtained from any appropriate source, such as a pressure sensor that furnishes pressure data for publishing the data link.

Logic function 22 compares the data values for ICP_VRE_OFF and BCP in the following way. If the data value for BCP is less than the data value for ICP_VRE_OFF, then logic function 22 causes the data value of a parameter ICP_VRE_BCP_MIN to be a logic "1" state. If the data value for BCP is not less than the data value for ICP_VRE_OFF, then logic function 22 causes the data value of parameter ICP_VRE_BCP_MIN to be a logic "0" state.

The data value ICP_VRE_BCP_MIN controls the running of a timer 24. As long as the data value for ICP_VRE_BCP_MIN is a logic "1", timer 24 runs. Should the data value for ICP_VRE_BCP_MIN become a logic "0", the timer is reset to zero, and can begin timing again from zero only when the data value for ICP_VRE_BCP_MIN once again becomes a logic "1".

The elapsed time on timer 24, represented by the parameter ICP_VRE_OFF_TMR is used as one input to another logic function 26 that compares the data value for ICP_VRE_OFF_TMR and the data value for a parameter ICP_VRE_OFF_TM. Logic function 26 compares the two data values in the following way. If the elapsed time on timer 24, ICP_VRE_OFF_TMR, is less than the time set by ICP_VRE_OFF_TM, then logic function 26 causes the data value for ICP_VRE_OFF_RESET to be a logic "0". If the data value for elapsed time on timer 24, ICP_VRE_OFF_TMR, is equal to or greater than the time set by ICP_VRE_OFF_TM, then logic function 26 causes the data value for ICP_VRE_OFF_RESET to be a logic "1".

The data value for ICP_VRE_OFF_TM is obtained from a map 28 that contains data values for ICP_VRE_TM each correlated with a respective pair of data values for engine speed and engine operating temperature representing a respective range of engine speeds and a respective range of engine operating temperatures. A data value for indicated engine operating temperature EOT as obtained from any appropriate source. The data values for indicated engine temperature EOT and indicated engine speed N form inputs to map 28. Processing of indicated engine speed N and indicated engine temperature EOT yields a corresponding data value for ICP_VRE_OFF_TM from map 28. Like map 20, map 28 is also populated during engine development.

The purpose of map 28 is to set a duration for the transition time interval based on engine speed and engine temperature. For timer 24 to time during that time interval, function 22 requires that a predetermined relationship exist between pressure of control fluid being applied to the brake actuator and injection control pressure ICP. If the predetermined relationship exists throughout the duration of the time interval set by map 28, then elapsed time on timer 24 will eventually reach the time established by map 28 whereupon function 26 will signal the end of the interval by resetting latch 18.

The resetting of latch 18 returns switch 16 to the first state so that ICP data values from strategy 12, and not ICP_VRE_OFF, will thereafter be supplied to the command input of virtual controller 14.

During the transition time interval, the hydraulic control fluid being applied to the brake actuator can be dumped as rapidly as possible to promote fast cylinder exhaust valve closings. The transitional ICP will continue to control ICP until the transitional strategy assures that the pressure being applied to the brake actuator has been reduced to at least a level consistent with the transitional ICP without exceeding that level for some minimum amount of time that is a function of engine speed and engine temperature. In other words, the strategy assures that a predetermined correlation between the transitional ICP and the indicated control fluid pressure acting on the brake actuator continually exists for some minimum interval of speed- and temperature-based time before ICP data values from strategy 12 are allowed to re-gain control of virtual controller 14.

While a presently preferred embodiment of the invention has been illustrated and described, it should be appreciated that principles of the invention apply to all embodiments falling within the scope of the following claims.

What is claimed is:

1. An internal combustion engine that propels a vehicle and comprises:

a fuel injection system for injecting fuel into engine cylinders at a desired injection control pressure;

a fluid-operated device that uses pressure of a control fluid for activating an engine brake to increase engine back pressure; and a control system for activating and de-activating the brake and that comprises a processor that processes data to develop desired injection control pressure data for controlling injection control pressure, that during activation of the brake develops desired injection control pressure data from a main ICP-determining strategy, and that upon the control system requesting de-activation of the brake develops desired injection control pressure data from a transitional ICP-determining strategy instead of the main ICP-determining strategy during a transition time interval that commences in response to the de-activation request and continues while pressure of the control fluid acting on the device is being relieved to allow resumption of positive power flow from the engine to propel the vehicle and that ends after the processor has determined the existence of a predetermined correlation between transitional injection control pressure data from the transitional ICP-determining strategy that is being used as desired injection control pressure data and data indicating pressure of the control fluid acting on the device.

2. An internal combustion engine as set forth in claim 1 wherein the processor determines the existence of the predetermined correlation as the continuous maintenance the predetermined correlation for an amount of time based on certain aspects of engine operation during the transition time interval.

3. An internal combustion engine as set forth in claim 2 wherein the processor processes data indicating engine operating temperature, data indicating engine speed, and the indicated control fluid pressure data to develop both the transitional injection control pressure data and data determining the end of the transition time interval.

4. An internal combustion engine as set forth in claim 3 wherein the processor processes at least one of indicated engine temperature data and indicated engine speed data to develop the data determining the end of the transition time interval.

5. An internal combustion engine as set forth in claim 4 wherein the processor processes both indicated engine temperature data and indicated engine speed data to develop the data determining the end of the transition time interval.

6. An internal combustion engine as set forth in claim 5 wherein the control system comprises a map containing data values for amounts of time, each correlated with a respective pair of data values for engine operating temperature and engine speed, and the processor processes data values for indicated engine operating temperature and for indicated engine speed to select from the map a data value for an amount of time correlated with the indicated engine operating temperature data and the indicated engine speed data, then processes the selected data value from the map and elapsed time data from a timer that runs only while the predetermined correlation is being continuously maintained between data values for indicated control fluid pressure and data values for transitional injection control pressure, and then when the amount of time that has elapsed on the timer is at least equal to the selected data value from the map, ends the use of the transitional injection control pressure data for desired injection control pressure.

7. An internal combustion engine as set forth in claim 6 wherein the processor resets the timer to zero whenever the processor discloses that a data value for indicated control fluid pressure and a data value for transitional injection control pressure fail to maintain the predetermined correlation.

8. An internal combustion engine as set forth in claim 3 wherein the processor comprises a virtual feedback control section that processes both command input data representing desired injection control pressure and feedback data indicating fuel injection pressure in closed-loop control of injection control pressure in accordance with data values for desired injection control pressure, and a switch for switching data values for transitional injection control pressure to the virtual feedback control section command input during the transition time interval.

9. An internal combustion engine as set forth in claim 8 wherein the processor comprises a latch that controls the switch and that is set at the commencement of the transition time interval to switch the transitional injection control pressure data values to the command input of the virtual feedback control section and is reset at the end of the transition time interval to discontinue switching the data value for transitional injection control pressure to the command input of the virtual feedback control section.

10. An internal combustion engine as set forth in claim 1 wherein the control system comprises a map containing data values for transitional injection control pressure, each correlated with a respective data value for engine speed, and the processor processes data values for indicated engine speed to select from the map a data value for transitional injection control pressure correlated with a data value for indicated engine speed.

11. An internal combustion engine as set forth in claim 10 wherein the control system comprises a further map containing data values for amounts of time, each correlated with a respective pair of data values for engine operating temperature and engine speed, and the processor processes data values for indicated engine operating temperature and for indicated engine speed to select from the further map a data value for an amount of time correlated with the indicated engine operating temperature data and the indicated engine speed data, then processes the selected data value from the further map and elapsed time data from a timer that runs only while the predetermined correlation is being continuously maintained between data values for indicated control fluid pressure and data values for transitional injection control pressure, and then when the amount of time that has elapsed on the timer is at least equal to the selected data value from the further map, ends the use of the transitional injection control pressure data for desired injection control pressure.

12. An internal combustion engine as set forth in claim 11 wherein the timer is reset to zero whenever the processor discloses that a data value for indicated control fluid pressure and a data value for transitional injection control pressure fail to maintain the predetermined correlation.

13. A method for controlling injection control pressure at which fuel is injected into cylinders of an internal combustion engine that propels a vehicle during a transition time interval that commences with de-activation of an engine brake by the relief of pressure of a control fluid that had been acting on a device which had been braking the engine, the method comprising:

developing transitional injection control pressure data for use as desired injection control pressure and using the transitional injection control pressure data, to the exclusion of injection control pressure data from other sources, as the desired injection control pressure data that controls injection control pressure during the transition time interval, and ending the transition time interval after the existence of a predetermined correlation between the transitional injection control pressure data and data indicating the pressure of control fluid acting on the device has been disclosed.

14. A method as set forth in claim 13 wherein the step of ending the transition time interval comprises determining that the predetermined correlation between the transitional injection control pressure data and the data indicating control fluid pressure has been continuously maintained for an amount of time based on certain aspects of engine operation during the transition time interval.

15. A method as set forth in claim 14 comprising processing data indicating engine operating temperature, data indicating engine speed, and the data indicating control fluid pressure acting on the device to develop both the transitional injection control pressure data and data determining the end of the transition time interval.

16. A method as set forth in claim 15 comprising processing at least one of indicated engine operating temperature data and indicated engine speed data to develop the data determining the end of the transition time interval.

17. A method as set forth in claim 14 comprising processing a data value for indicated engine speed to select from a map containing data values for transitional injection control pressure, each correlated with a respective data value for engine speed, a data value for transitional injection control pressure correlated with the data value for indicated engine speed.

18. A method as set forth in claim 17 comprising processing data values for indicated engine operating temperature and indicated engine speed to select from a further map containing data values for amounts of time, each correlated with a respective pair of data values for engine operating temperature and engine speed, a data value for an amount of time correlated with the indicated engine operating temperature and the indicated engine speed data values, then processing the selected data value from the further map and elapsed time data from a timer that runs only when data values for transitional injection control pressure and for indicated control fluid pressure acting on the device are maintaining the predetermined correlation, and then when the amount of elapsed time on the timer is at least equal to the selected data value from the further map, ending the use of the transitional injection control pressure data for desired injection control pressure.

19. A control system for controlling pressure at which a fuel injection system injects fuel into engine cylinders of an internal combustion engine that propels a vehicle during a transition time interval commencing with de-activation of an engine brake by the relief of pressure of a control fluid that had previously been acting on the device to cause increased engine back-pressure, the control system comprising:

a processor for establishing desired injection control pressure and for causing the relief of pressure of the control fluid acting on the device;

wherein the processor processes various data to develop transitional injection control pressure data for use as desired injection control pressure data to the exclusion of injection control pressure data from other sources during the transition time interval and to develop data that determines the end of the transition time interval, wherein the processor processes certain data that includes at least indicated pressure of control fluid acting on the device and engine speed data in accordance with maps to select from the maps data values that are further processed to project a length of time for the transition time interval and to signal the end of the transition time interval upon pressure of control fluid acting on the device and transitional injection control pressure having maintained a predetermined correlation for the projected length of time.

20. A control system as set forth in claim 19 wherein a first map comprises data values for transitional injection control pressure each correlated with a respective data value for engine speed, a second map comprises data values for amounts of time, each correlated with a respective pair of data values for engine operating temperature and engine speed, the processor processes data values selected from the first map in accordance with indicated engine speed to set a data value for transitional injection control pressure, and the processor also processes data values selected from the second map in accordance with indicated engine operating temperature and indicated engine speed to set a data value for the projected length of the transition time interval.

21. A control system as set forth in claim 20 further comprising a timer that the processor allows to run only so long as data values for the indicated control fluid pressure acting on the device and the transitional injection control pressure continuously maintain the predetermined correlation, and wherein the processor processes data values for elapsed time on the timer and for the projected length of the transition time interval to determine the end of the transition time interval, with the processor resetting the elapsed time on the timer to zero whenever data values for indicated control fluid pressure acting on the device and transitional injection control pressure fail to maintain the predetermined correlation.

* * * * *